US009451684B2

(12) United States Patent
Corliss et al.

(10) Patent No.: US 9,451,684 B2
(45) **Date of Patent: *Sep. 20, 2016**

(54) DUAL PULSE DRIVEN EXTREME ULTRAVIOLET (EUV) RADIATION SOURCE METHOD

(71) Applicant: International Business Machines Corporation, Armonk, NY (US)

(72) Inventors: Daniel A. Corliss, Hopewell Junction, NY (US); Sadanand V. Deshpande, Bangalore (IN); Veeresh V. Deshpande, Rueschlikon (CH); Oleg Gluschenkov, Poughkeepsie, NY (US); Sivarama Krishnan, Prasanthi Nilayam (IN)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/077,187

(22) Filed: Mar. 22, 2016

(65) Prior Publication Data

US 2016/0205757 A1 Jul. 14, 2016

Related U.S. Application Data

(63) Continuation of application No. 14/484,996, filed on Sep. 12, 2014, now Pat. No. 9,301,381.

(51) Int. Cl.
*H05G 2/00* (2006.01)

(52) U.S. Cl.
CPC ..... *H05G 2/005* (2013.01); *H05G 2/003* (2013.01); *H05G 2/008* (2013.01)

(58) Field of Classification Search
CPC ..... H05G 2/00; H05G 2/001; H05G 2/003; H05G 2/005; H05G 2/006; H05G 2/008
See application file for complete search history.

(56) References Cited

U.S. PATENT DOCUMENTS 5,577,092 A 11/1996 Kublak et al.
5,991,360 A 11/1999 Matsui et al.

(Continued)

FOREIGN PATENT DOCUMENTS

EP 2475228 A1 7/2012
JP 2003297737 A 10/2003
JP 200871570 A 3/2008

OTHER PUBLICATIONS

Gomez, LF et al., "Sizes of large He droplets" J Chem Phys. (Oct. 21, 2011) pp. 154201-1-154201-9, vol. 135, No. 15.

(Continued)

*Primary Examiner* — Nicole Ippolito
*Assistant Examiner* — Sean Luck
(74) *Attorney, Agent, or Firm* — Scully, Scott, Murphy & Presser, P.C.; Steven J. Meyers

(57) ABSTRACT

An extreme ultraviolet (EUV) radiation source pellet includes at least one metal particle embedded within a heavy noble gas cluster contained within a noble gas shell cluster. The EUV radiation source assembly can be activated by a sequential irradiation of at least one first laser pulse and at least one second laser pulse. Each first laser pulse generates plasma by detaching outer orbital electrons from the at least one metal particle and releasing the electrons into the heavy noble gas cluster. Each second laser pulse amplifies the plasma embedded in the heavy noble gas cluster triggering a laser-driven self-amplifying process. The amplified plasma induces inter-orbital electron transitions in heavy noble gas and other constitute atoms leading to emission of EUV radiation. The laser pulsing units can be combined with a source pellet generation unit to form an integrated EUV source system.

19 Claims, 4 Drawing Sheets

(56) References Cited

U.S. PATENT DOCUMENTS

| | | | |
|---|---|---|---|
| 6,275,565 | B1 | 8/2001 | Tomie |
| 6,493,423 | B1 | 12/2002 | Bisschops |
| 6,831,963 | B2 | 12/2004 | Richardson |
| 6,862,339 | B2 | 3/2005 | Richardson |
| 6,897,456 | B2 | 5/2005 | Hasegawa et al. |
| 6,924,600 | B2 | 8/2005 | Mochizuki |
| 7,317,196 | B2 | 1/2008 | Partlo et al. |
| 7,476,884 | B2 | 1/2009 | Gaebel et al. |
| 7,642,533 | B2 | 1/2010 | Partio et al. |
| 7,800,086 | B2 | 9/2010 | Ziener et al. |
| 7,838,854 | B2 | 11/2010 | Algots et al. |
| 8,258,485 | B2 | 9/2012 | Levesque et al. |
| 8,269,199 | B2 | 9/2012 | McGeoch |
| 8,368,032 | B2 | 2/2013 | Labetski et al. |
| 8,368,040 | B2 | 2/2013 | Loopstra et al. |
| 8,507,882 | B2 | 8/2013 | Swinkels et al. |
| 8,536,549 | B2 | 9/2013 | Tao et al. |
| 8,604,452 | B2 | 12/2013 | Ershov |
| 2003/0223546 | A1 | 12/2003 | McGregor et al. |
| 2005/0205810 | A1 | 9/2005 | Akins et al. |
| 2005/0205811 | A1 | 9/2005 | Partlo et al. |
| 2006/0043319 | A1 | 3/2006 | Gaebel et al. |
| 2008/0237498 | A1 | 10/2008 | MacFarlane |
| 2012/0025109 | A1 | 2/2012 | Abhari et al. |
| 2013/0153603 | A1 | 6/2013 | De Dea et al. |

OTHER PUBLICATIONS

Ratschek, M. et al., "Doping helium nanodroplets with high temperature metals: Formation of chromium clusters" J. Chem. Phys. (Mar. 13, 2012) pp. 104201-1-104201-6, vol. 136.

Krishnan, S.R. et al., "Dopant-Induced Ignition of Helium Nanodroplets in Intense Few-Cycle Laser Pulses" Physical Review Letters (Oct. 21, 2011) pp. 173402-1-173402-4, vol. 107.

Brandt, D.C. et al., "Laser Produced Plasma EUV Sources for Device Development and HVM" Proc. SPIE 8322, Extreme Ultraviolet (EUV) Lithography III (Mar. 29, 2012) pp. 1-11, vol. 8322.

International Search Report and Written Opinion dated Nov. 10, 2015 received in a corresponding foreign application.

List of IBM Patents or Patent Applications Treated As Related dated Mar. 22, 2016, 2 pages.

DUAL PULSE DRIVEN EXTREME ULTRAVIOLET (EUV) RADIATION SOURCE METHOD

BACKGROUND

The present disclosure relates to an extreme ultraviolet (EUV) radiation source activated by dual laser pluses and an apparatus for generating EUV radiation by generating and activating the same.

Extreme ultraviolet (EUV) technology refers to lithography technology using an extreme ultraviolet (EUV) wavelength. Current EUV technology focuses on generating a narrow band electromagnetic radiation having a wavelength about 13.5 nm. Alternatively, EUV radiation can be referred to as soft x-ray since it falls in between x-ray and ultraviolet bands. Inter-orbital atomic and molecular emissions are potential sources for generating such an electromagnetic radiation.

In theory, source targets can be solid, liquid droplets, or gas. Known EUV source types include discharge produced plasma (DPP) systems, laser produced plasma (LPP) systems, and synchrotron source systems. Among these systems, LPP systems have been known to provide high intensity of EUV radiation, and currently are a subject of extensive research efforts.

SUMMARY

An extreme ultraviolet (EUV) radiation source pellet includes at least one metal particle embedded within a heavy noble gas cluster contained within a noble gas shell cluster. The EUV radiation source assembly can be activated by a sequential irradiation of at least one first laser pulse and at least one second laser pulse. Each first laser pulse generates plasma by detaching outer orbital electrons from the at least one metal particle and releasing the electrons into the heavy noble gas cluster. Each second laser pulse amplifies the plasma embedded in the heavy noble gas cluster triggering a laser-driven self-amplifying process in which more plasma energy induces more free electrons and vice versa. The amplified plasma induces inter-orbital electron transitions in heavy noble gas and other constitute atoms leading to emission of EUV radiation. The laser pulsing units can be combined with a source pellet generation unit to form an integrated EUV source system.

According to an aspect of the present disclosure, an apparatus for generating an extreme ultraviolet (EUV) radiation is provided. The apparatus includes an extreme ultraviolet (EUV) radiation source pellet generator configured to generate EUV radiation pellets. Each EUV radiation pellet contains at least one metallic particle, which is an atom of a metallic element or an aggregate of multiple atoms of a metallic element, a heavy noble gas cluster embedding the at least one metallic particle, and a noble gas shell cluster embedding this heavy noble gas cluster. The noble gas cluster is a solid or liquid phase aggregate of light noble gas atoms selected from He, Ne, and Ar. The apparatus further includes at least one irradiation source. Each irradiation source is configured to irradiate a laser beam toward a path of the EUV radiation pellets.

According to another aspect of the present disclosure, an extreme ultraviolet (EUV) radiation source pellet is provided, which includes at least one metallic particle, a heavy noble gas cluster embedding the at least one metallic particle, and a noble gas shell cluster embedding the heavy noble gas cluster and containing a cluster of a light noble gas selected from He, Ne, and Ar.

DETAILED DESCRIPTION

Figures 1A, 1B, 1C:
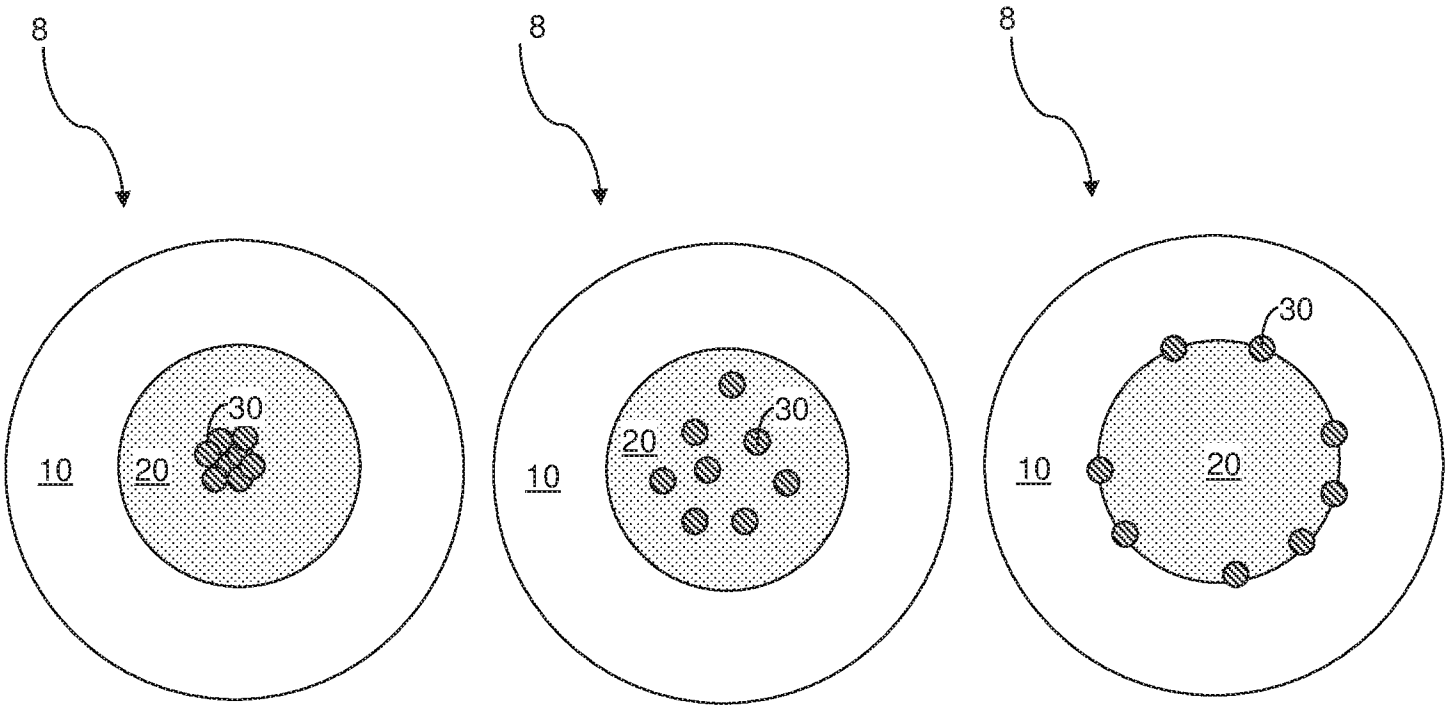
FIG. 1A is a schematic illustration of a first exemplary extreme ultraviolet (EUV) source pellet according to an embodiment of the present disclosure.
FIG. 1B is a schematic illustration of a second exemplary EUV radiation source pellet according to an embodiment of the present disclosure.
FIG. 1C is a schematic illustration of a third exemplary EUV radiation source pellet according to an embodiment of the present disclosure.

As stated above, the present disclosure relates to an extreme ultraviolet (EUV) radiation source activated by dual laser pluses and an apparatus for generating EUV radiation by generating and activating the same. Aspects of the present disclosure are now described in detail with accompanying figures. Throughout the drawings, the same reference numerals or letters are used to designate like or equivalent elements. The drawings are not necessarily drawn to scale.

Referring to FIGS. 1A, 1B, and 1C, exemplary extreme ultraviolet (EUV) source pellets 8 are schematically illustrated. FIG. 1A is a schematic of a first exemplary EUV radiation source pellet 8, FIG. 1B is a schematic of a second exemplary EUV radiation source pellet 8, and FIG. 1C is a schematic of a third exemplary EUV radiation source pellet 8 As used herein, a "pellet" refers to a spherical or non-spherical composite particle including at least two component materials and having a maximum dimension not greater than 100 μm.

Each exemplary EUV radiation source pellet 8 includes a noble gas shell cluster 10. As used herein, a "cluster" refers to a physically adjoined set of atoms or molecules. As used herein, a "shell cluster" refers to a cluster in a configuration of a shell that embeds an object therein such that the object is physically separated from any other element outside of the shell cluster by the shell cluster. As used herein, a "noble gas shell cluster" refers to a shell cluster consisting essentially of at least one light noble gas. Thus, the composition of the noble gas shell cluster 10 can consist of at least one noble gas, or can consist of at least one light noble gas and trace level impurity atoms. The trace level impurity atoms if present, do not exceed an impurity level as known in the art, e.g., below 10 p.p.m., and preferably below 1 p.p.m. As used herein, a light noble gas refers to any one of He, Ne, and Ar.

In one embodiment, the noble gas shell cluster 10 can consist essentially of a single noble gas selected from He, Ne, and Ar. In one embodiment, the total number of atoms of the light noble gas in the noble gas shell cluster 10 can be in a range from $10^4$ to $10^{16}$, although a lesser or greater number of atoms of the light noble gas can be present in the noble gas shell cluster 10. In another embodiment, the total number of atoms of the light noble gas in the noble gas shell cluster 10 can be in a range from $10^{10}$ to $10^{15}$.

Each exemplary EUV radiation source pellet 8 further includes a heavy noble gas cluster 20 that is embedded within the noble gas shell cluster 10. As used herein, a "heavy noble gas" refers to any of Xe, Kr, and Rn. Although Xe atoms are well suited for generating EUV radiation at around 13.5 nm, other heavy noble gases such Kr or Rn may also be employed as an alternative. In one embodiment, the heavy noble gas is xenon. The composition of the heavy noble gas cluster 20 can consist of heavy noble gas atoms, or a combination of heavy noble gas atoms and trace level impurity atoms. The trace level impurity atoms if present, do not exceed an impurity level as known in the art, e.g., below 10 p.p.m., and preferably below 1 p.p.m.

The maximum dimension of the heavy noble gas cluster 20 is less than the maximum dimension of the noble gas shell cluster 10. Because the heavy noble gas cluster 20 maintains a higher density due to inherent stronger adhesion of the heavy noble gas atoms than the light noble gas atoms in the noble gas shell cluster 10, the heavy noble gas cluster 20 is located approximately at the geometrical center of the noble gas shell cluster 10. It is further noted that heavy noble gas atoms have enough time to defuse to the center of the cluster to form a heavy noble gas center agglomerate. The speed of heavy noble gas diffusion within the shell cluster 10 depends on the cluster noble gas. Selecting lighter noble gas results in faster heavy noble gas diffusion within the shell cluster 10. Consequently, He-based shell cluster 10 is preferred.

In one embodiment, the total number of atoms of the light noble gas in the noble gas shell cluster 10 can be greater than the total number of heavy noble gas atoms in the heavy noble gas cluster by a factor of at least two. In another embodiment, the total number of atoms of the light noble gas in the noble gas shell cluster 10 can be greater than the total number of heavy noble gas atoms in the heavy noble gas cluster by a factor of at least 100. In yet another embodiment, the total number of heavy noble gas atoms in the heavy noble gas cluster 20 can be in a range from $10^3$ to $10^{15}$.

Each exemplary EUV radiation source pellet 8 further includes at least one metallic particle 30. At least one metallic particle 30 is embedded within the heavy noble gas cluster 20. In one embodiment, a plurality of metallic particles 30 can be embedded within the heavy noble gas cluster 20. In one embodiment, the plurality of metallic particles 30 may be present as a cluster of metallic particles 30 as in the first exemplary EUV radiation source pellet 8 illustrated in FIG. 1A. In this case, the plurality of metallic particles 30 can be in a configuration of a cluster in which the metallic particles 30 are in physical contact with one another. In another embodiment, the plurality of metallic particles 30 may be present as dispersed metallic particles 30 that are scattered within the heavy noble gas cluster 20 and do not contact one another as in the second exemplary EUV radiation source pellet 8 illustrated in FIG. 1B. In yet another embodiment, the plurality of metallic particles 30 may be present as dispersed metallic particles 30 that are scattered at the interface of the heavy noble gas cluster 20 and the outer shell 10 as illustrated in FIG. 1C.

Each metallic particle 30 can be a single atom particle of a metallic element, or can include a nanoparticle including a plurality of atoms of a metallic element. As used herein, a nanoparticle refers to a particle having a maximum dimension that does not exceed 100 nm. The number of atoms in a metallic particle can be, for example, in a range from 1 to 100. The total number of heavy noble gas atoms in the heavy noble gas cluster 20 can be greater than a total number of the atoms in all metallic particles 30 by a factor of at least ten. In one embodiment, the total number of heavy noble gas atoms in the heavy noble gas cluster 20 can be greater than a total number of the atoms in all metallic particles 30 by a factor of at least one hundred. In another embodiment, the total number of heavy noble gas atoms in the heavy noble gas cluster 20 can be greater than a total number of the atoms in all metallic particles 30 by a factor of at least one thousand.

The metallic element within the metallic particles 30 can be any metallic element that can be excited to generate a plasma under irradiation by a laser beam. The metallic element within the metallic particles 30 can be a transition metal element, a Lanthanide element, an Actinide element, Al, Ga, In, Tl, Sn, Pb, or Bi. In one embodiment, the metallic element can be tin (Sn).

Figure 2:
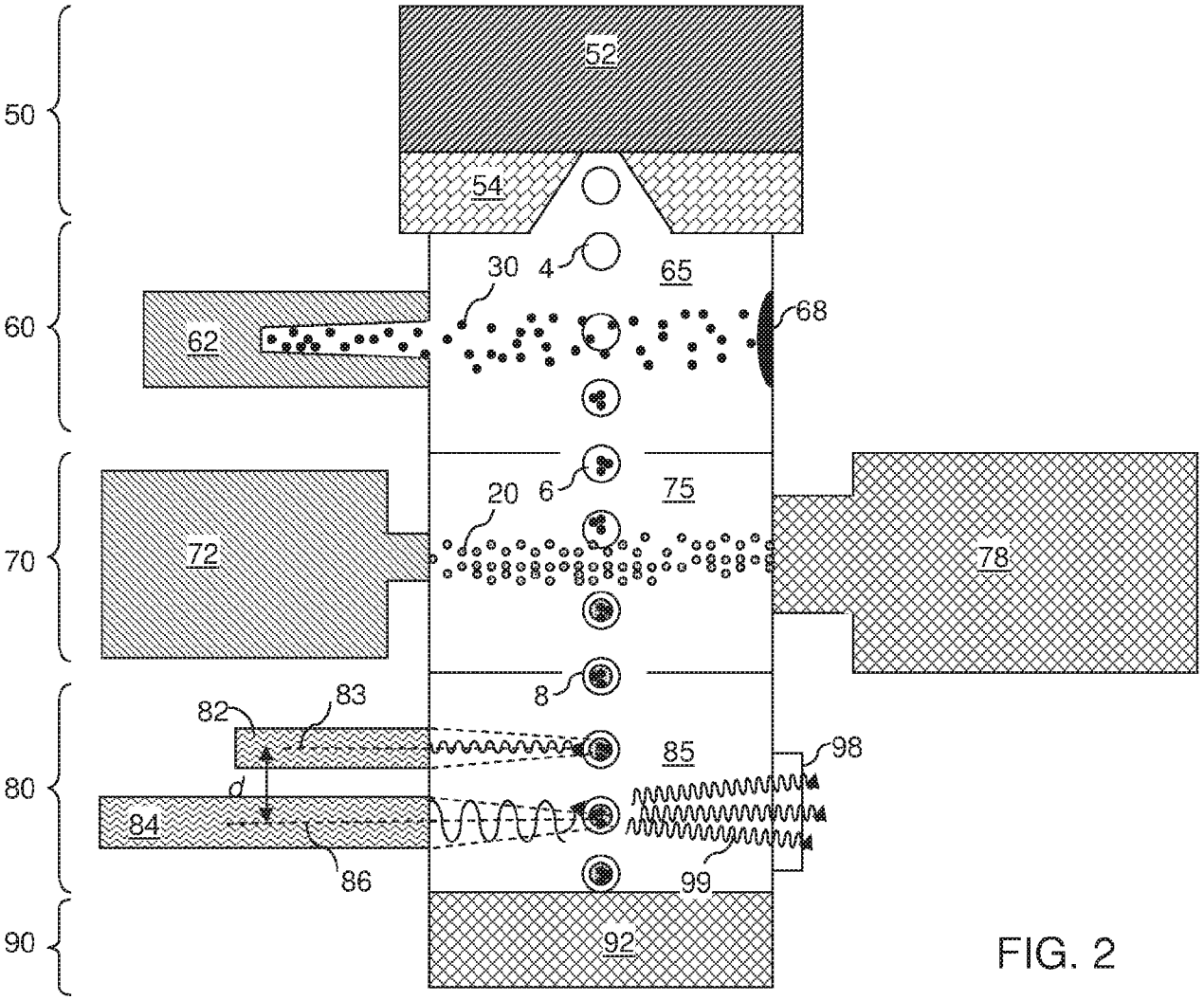
FIG. 2 is a schematic view of a first exemplary apparatus for generating EUV radiation according to a first embodiment of the present disclosure.

Referring to FIG. 2, a first exemplary apparatus for generating EUV radiation according to a first embodiment of the present disclosure includes an extreme ultraviolet (EUV) radiation source pellet generator (50, 60, 70) configured to generate EUV radiation pellets 8. Each EUV radiation pellet 8 contains at least one metallic particle 30, a heavy noble gas cluster 20 embedding the at least one metallic particle 30, and a noble gas shell cluster 10 embedding the heavy noble gas cluster 20 and containing a cluster of a noble gas selected from He, Ne, and Ar. The first exemplary apparatus further includes at least one irradiation source (82, 84). Each of the irradiation sources are focused on to their respective focal plane (83, 86). Each of the at least one laser irradiation source (82, 84) can be configured to irradiate a laser beam toward a path of the EUV radiation pellets 8 at their respective focal plane (83, 86). The first exemplary apparatus can include a vacuum enclosure in which the EUV radiation source pellets 8 are generated and irradiated by at least one irradiation source.

The EUV radiation source pellet generator (50, 60, 70) includes a droplet generator unit 50 configured to emit clusters of a noble gas selected from He, Ne, and Ar along a droplet transit path. Each cluster 4 of the noble gas can be a substantially spherical noble gas droplet consisting essentially of a light noble gas selected from He, Ne, and Ar. Each cluster 4 of the noble gas can be substantially spherical due to the surface tension, close packing or crystallization, as the case may be, of the atoms of the light noble gas therein. The droplet generator unit 50 can include a droplet source tank 52 in which the light noble gas is stored, and a droplet ejection device 54 that includes an opening through which clusters 4 of the light noble gas are emitted. The droplet generator unit 50 can be configured to emit the clusters 4 of the light noble gas downward. In one embodiment, each cluster 4 of the light noble gas can be emitted with negligible lateral velocity so that the droplet transit path can be a substantially vertical downward line. The droplet generator unit 50 can be employed such that clusters 4 of the light noble gas can be emitted into the vacuum enclosure along a well-defined particle path. The droplet generator works by expanding the light noble gas into vacuum through a nozzle in such a way that the pressure after the nozzle (vacuum side) is less than about 40% of the pressure before the nozzle at the source tank side. Nozzle conditions of the droplet generator 50 (temperature, pressure, nozzle diameter) can be tuned to control size and density of clusters 4 generated. This allows one to control the density of pellets 8 and hence the number of pellets being irradiated in the focal volume of irradiation source.

The EUV radiation source pellet generator (50, 60, 70) includes a metallic particle impregnation unit 60 that is adjoined to the droplet generator unit 50. The metallic particle impregnation unit 60 includes a metallic particle generator 62 configured to emit metallic particles 5 along a metallic particle beam direction that intersects the droplet transit path at a region, which is herein referred to as a first intersect region. The metallic particle impregnation unit 60 further includes a first vacuum chamber 65, which is a portion of the vacuum enclosure into which the clusters 4 of the light noble gas are emitted from the droplet generator unit 50. The metallic particle generator 62 can be any source that can generate a beam of metallic particles 30, which can have any of the metallic compositions described above. The typical particle beam generator includes the thermally generated beam of metallic atoms. The beam of metallic particles 30 can cause formation of a metallic deposit portion 68 at a wall of the first vacuum chamber 65. The metallic particle impregnation unit 60 generates metallic particle that collide with the droplet 10, condense on the surface of the droplet 10, and then diffuse to center of droplet 10, and thereafter agglomerate at the center of the droplet 10. Accordingly, the impregnated noble gas clusters 6 forms the combinations of the clusters 4 of the light noble gas and the metallic particles 30 in the center of droplet 10.

The EUV radiation source pellet generator (50, 60, 70) further includes a heavy noble gas cluster impregnation unit 70. The heavy noble gas cluster impregnation unit 70 includes a heavy noble gas cluster generator 72 configured to emit heavy noble gas clusters 20 along a heavy noble gas beam direction that intersects the droplet transit path at a region, which is herein referred to as a second intersect region. The heavy noble gas cluster impregnation unit 70 further includes a second vacuum chamber 75 that is adjoined to the first vacuum chamber 65 through an opening. The second vacuum chamber 75 is a portion of the vacuum enclosure into which the metallic particle impregnated noble gas clusters 6 are emitted from the first vacuum chamber 65. The metallic particle impregnated noble gas clusters 6 enter the second vacuum chamber 75 through an opening between the first vacuum chamber 65 and the second vacuum chamber 75. The heavy noble gas cluster generator 72 can be configured to generate heavy noble gas clusters 20 from a heavy noble gas source tank (not expressly shown) and to emit the heavy noble gas clusters 20 along a direction that intersects the path of the clusters of the noble gas as impregnated with at least one metallic particle 30. The heavy noble gas cluster 20 is an aggregate with more than one heavy noble gas atom. At least one heavy noble gas cluster 20 is impregnated into the noble gas cluster 6 impregnated with at least one metallic particle 30. Multiple heavy noble gas clusters 20 impregnated into the noble gas cluster 6, impregnated with at least one metallic particle, may typically coagulate at the center of the noble gas cluster 6 after impregnation.

A vacuum pump 78 can be attached to the second vacuum chamber 75 on the opposite side of the heavy noble gas cluster generator 72 so that the heavy noble gas clusters 20 that are not incorporated into the metallic particle impregnated noble gas clusters 6 are pumped away from the second vacuum chamber 75. The heavy noble gas cluster impregnation unit 70 generates EUV radiation source pellets 8 from combinations of the metallic particle impregnated noble gas clusters 6. The collection of the noble gas atoms in each EUV radiation source pellet 8 constitutes a noble gas cluster 10 that embeds a heavy noble gas cluster 20 and at least one metallic particle 30. Each noble gas cluster 10 can have a configuration of a shell that encases a heavy noble gas cluster 20 and a plurality of metallic particles 30 therein. The EUV radiation source pellets 8 of the first embodiment can be the same as the EUV radiation source pellets 8 illustrated in FIGS. 1A-1C.

In each of the EUV radiation source pellets 8, the total number of atoms of the light noble gas contained in the noble gas cluster 10 is greater than the total number of heavy noble gas atoms in the heavy noble gas cluster 20 by a factor of at least two. In one embodiment, the total number of atoms of the light noble gas in the noble gas shell cluster 10 can be greater than the total number of heavy noble gas atoms in the heavy noble gas cluster by a factor of at least 10. In another embodiment, the total number of atoms of the light noble gas in the noble gas shell cluster 10 can be greater than the total number of heavy noble gas atoms in the heavy noble gas cluster by a factor of at least 100. In yet another embodiment, the total number of heavy noble gas atoms in the heavy noble gas cluster 20 can be in a range from $10^3$ to $10^{15}$.

The first intersect region at which the metallic particles 30 are incorporated into a cluster 4 of the light noble gas is located in the first vacuum chamber 65, and the second intersect region at which the heavy noble gas clusters 20 are incorporated into the metallic particle impregnated noble gas clusters 6 in the second vacuum chamber 75. As such, the first intersect region is more proximal to the location at which the clusters 4 of the light noble gas are emitted, i.e., the opening in the droplet generator unit 50, than the second intersect region is to the location at which the clusters 4 of the light noble gas are emitted.

The first exemplary apparatus can further include a radiation generation unit 80. The radiation generation unit 80 includes a third vacuum chamber 85, which is a portion of the vacuum enclosure and is connected to the second vacuum chamber 75 via an opening. The EUV radiation source pellets 8 can pass from the second vacuum chamber 75 into the third vacuum chamber 85 by a gravitational pull and/or due to the substantially vertical downward linear momentum of pellets 8. In this case, the path of the EUV radiation source pellets 8 within the third vacuum chamber 8 can be is substantially vertical downward path. As the pellets 8 have significant momentum (due to injection source) the whole apparatus can be operated in horizontal direction without depending on gravitation for pellet flow.

The radiation generation unit 80 further includes at least one irradiation source (82, 84), which can include a first irradiation source 82 configured to excite a plasma from the at least one metallic particle 30 within the EUV radiation source pellets 8 and a second irradiation source 84 configured to amplify and heat the plasma of the at least one metallic particle and to generate a hot plasma within the heavy noble gas cluster 20. Both of the sources are focused on their respective focal planes (83, 86), respectively. Typical beam size of the focal plane is about 100 microns limiting the maximum pellet 8 size to about this dimension. In another embodiment smaller size pellets 8 with higher density can be present in focal volume of irradiation source (82, 84), with more than one pellet 8 being irradiated at the same time. The focal planes (83, 86) are separated by a vertical distance d.

In one embodiment, the first irradiation source 82 can be a first laser source configured to irradiate a first laser beam at a first point in the path of the EUV radiation pellets 8, and the second irradiation source 84 can be a second laser source configured to irradiate a second laser beam at a second point in the path of the EUV radiation pellets. The second point is more distal from the location at which the EUV radiation pellets 8 are generated from the combination of the metallic particle impregnated noble gas clusters 6 and the heavy noble gas clusters 20 than the first point is from the location at which the EUV radiation pellets 8 are generated.

Since the first irradiation source 82 excites a plasma from the at least one metallic particle 30 within the EUV radiation source pellets 8 and the second irradiation source 84 amplifies and heats the plasma exciting inter-orbital electron transitions in the heavy noble gas cluster 20, the wavelength and the intensity of the laser beams from the first and second irradiation sources can be tailored to achieve the aforementioned two different purposes. The distance d between the focal planes (83, 86) is selected to be short enough that the initial plasma generated in the first laser irradiation does not have enough time to decay significantly before it is exposed to the second irradiation and the pellet expansion caused by the first irradiation does not lead to full pellet disintegration prior to second irradiation. The distance d is so chosen, based on velocity of pellet 8, such that the second laser irradiation transfers maximum power to initial plasma generated in the first laser irradiation. To further reduce the unwanted plasma decay and excessive pellet expansion, the distance d can be reduced to near zero by overlapping focal planes (83, 86) in the vicinity of EUV pellet path. The overlapping of focal planes can be achieved by tilting irradiation sources (82, 84) with respect to each other (not shown).

In general, generation of an initial plasma from a pure heavy noble gas cluster takes more energy than generation of an initial plasma from pure metallic droplets. This disparity in plasma generation thresholds is especially large for longer-wavelength radiation that couples laser energy into free electrons that are present in metallic droplets but initially absent in noble gas clusters. A high power threshold for ionizing or igniting pure heavy noble gas clusters leads to a reduced efficiency for converting laser power into EUV radiation. It is due to this reason, the state of the art EUV sources excite pure metallic (tin) droplets by a 10.6-um laser. The present invention overcomes these limitations by incorporating metallic particles 30 into heavy noble gas cluster 20 and by employing a dual pulse irradiation scheme. In the dual pulse scheme, the purpose of the first irradiation is to ionize metallic particles creating initial plasma within heavy noble gas cluster 20. The purpose of the second irradiation is to amplify initial plasma and to bring its electron temperature high enough for exciting EUV radiation. Correspondingly, the second laser beam from the second irradiation source 84 can have an intensity that is greater than an intensity of the first laser beam from the first irradiation source 82 by a factor of at least 3. In one embodiment, the second laser beam from the second irradiation source 84 can have an intensity that is greater than an intensity of the first laser beam from the first irradiation source 82 by a factor of at least 2. In another embodiment, the second laser beam from the second irradiation source 84 can have an intensity that is greater than an intensity of the first laser beam from the first irradiation source 82 by a factor of at least 100.

Further, the wavelength of the first laser beam from the first irradiation source 82 is selected such that the irradiated beam couples with electrons of the metallic particles 30. Unlike relatively large metallic droplets, metallic nanoparticles 30 may not have a sufficient number of free electrons within. In this case, the first irradiation couples into outer shell electrons initiating ionization. Generally, initiating ionization of metal atoms requires a high photon energy corresponding to the wavelengths of visible light (from 400 nm to 800 nm) or the wavelengths of ultraviolet radiation (from 10 nm to 400 nm). Thus, the wavelength of the first laser beam from the first irradiation source 82 can be selected to be from this range.

In contrast, the wavelength of the second laser beam is not limited to a wavelength range for coupling with a metallic atom because a preexisting plasma containing free electrons already dissociated from the metallic particles 30 can be amplified, and thus, cause generation of a dense plasma within heavy noble gas cluster 20 by absorbing the photon energy of the incoming radiation by free plasma electrons. Thus, the wavelength of the second laser beam from the second irradiation source 84 can be selected at an arbitrary wavelength provided that the second irradiation source 84 can deliver a high intensity laser beam irrespective of the wavelength of the second laser beam. In one embodiment, the second laser beam can have a longer wavelength than the first laser beam. For example, the second laser beam can have a wavelength longer than 800 nm, and the first laser beam can have a wavelength shorter than 800 nm. In one embodiment, the second irradiation source 84 can be a far infrared laser irradiation source such as a $CO_2$ laser operating at the wavelength of about 10,600 nm. A $CO_2$ laser is preferred due to its known superior power efficiency and scalability. In one embodiment, the second laser beam is a laser beam from a $CO_2$ laser.

In one embodiment, the power output of the first laser beam from the first irradiation source can be in a range from 1,000 Watt to 20,000 Watts or from 1 kW to 20 kW, and the power output of the second laser beam from the second irradiation source can be in a range from 10,000 Watt to 200,000 Watts or from 10 kW to 200 kW, although lesser and greater power output levels can also be employed for each. In order to achieve these record levels of power output, the lasers are operated in the pulsed mode with a typical repetition rate of from about 10 kHz to about 100 kHz with the rate of 50 kHz being more typical. Pulsing of the first irradiation source 82 and the second irradiation source 84 are synchronized with each other and with the passing of pellet 8 through the respective focal planes (83, 86).

The heavy noble gas atoms in the EUV radiation source pellets 8 generate extreme ultraviolet radiation upon irradiation with the second laser beam. The third vacuum chamber 85 can include a filter window 98 on a sidewall so that EUV radiation 99 in a desired wavelength range, such as a narrow band of radiation around 13.5 nm in wavelength, can pass through the filter window 98, while electromagnetic radiation outside the desired wavelength range does not pass through the filter window 98. During the irradiation processes, the pellet 8 expands and eventually explodes. The remaining pellet 8 debris must be pumped out of the vacuum chamber 85. The noble gas based pellets 8 of the present invention are advantageous over pure metallic droplets because the noble gas can be easily pumped out without much re-deposition onto the sensitive window 98. The EUV radiation source pellet 8 debris can be pumped out of the third vacuum chamber 85 by a vacuum pump 92 in a pumping unit 90, which can be optionally connected to a recycling unit to separate, and to recycle or reuse, the various components of the EUV radiation source pellets 8.

Figure 3A:
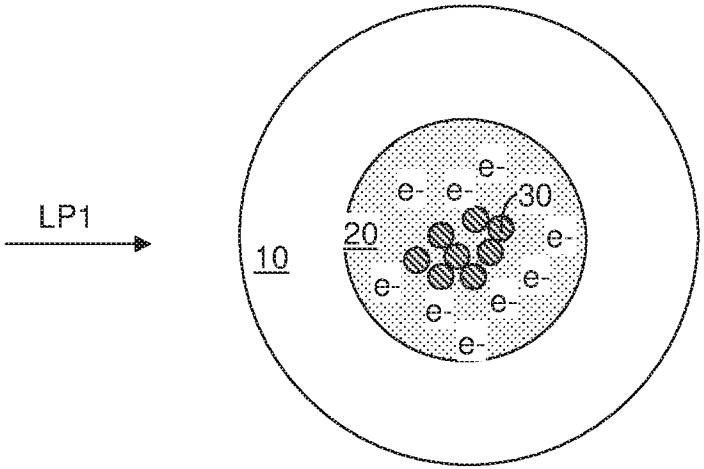
FIG. 3A is a schematic view of an exemplary EUV radiation source pellet after irradiation by a first laser beam according to an embodiment of the present disclosure.
Figure 3B:
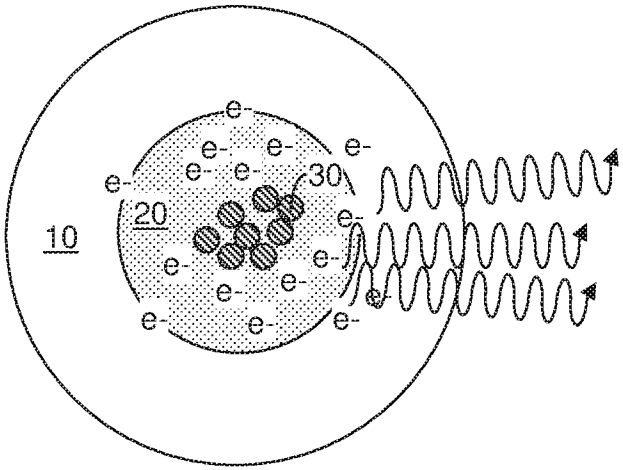
FIG. 3B is a schematic view of the exemplary EUV radiation source pellet after irradiation by a second laser beam according to an embodiment of the present disclosure.

The process of excitation of the EUV radiation source pellets 8 is illustrated in FIGS. 3A and 3B. FIG. 3A schematically illustrates an exemplary EUV radiation source pellet 8 after irradiation by a first laser beam from the first irradiation source 82. The energy in the first laser beam is absorbed by the at least one metallic particle 30, and generates a plasma of electrons dissociated from the at least one metallic particle 30. While the plasma generated from the first laser beam is active, the second laser beam is irradiated on the plasma and amplifies and heats the plasma from the at least one metallic particle 30 as illustrated in FIG. 3B. The amplified plasma from the at least one metallic particle 30 induces generation of another more dense plasma from the electrons within the heavy noble gas cluster 20. The energy of the second laser beam is further absorbed by the plasma generated within the heavy noble gas cluster 20, and the excited plasma emits the EUV radiation 99 that is filtered and emitted through the filter window 98.

The radiation generation unit 80 thus employs a two pulse plasma excitation scheme to effectively reduce the ionization threshold. Specifically, use of the at least one metallic particle 30 within the EUV radiation source pellet 8 enables generation of an initial plasma from the at least one metallic particle 30. The electrons in the plasma generated from the at least one metallic particle 30 lowers the effective ionization threshold energy for the heavy noble gas atoms during the irradiation by the second laser pulse. Thus, the plasma from the at least one metallic particle 30 enables absorption of energy from the second laser beam during the irradiation by the second irradiation source 84 even if the wavelength of the second laser beam is not short enough to induce direct excitation of plasma from the heavy noble gas atoms. In other words, by inducing a plasma condition around the heavy noble gas atoms in the heavy noble gas cluster 20, the electrons in the plasma couple with the second laser beam, and enable generation, amplification, and heating of plasma from the heavy noble gas atoms. The at least one metallic particle 30 functions as a dopant within the EUV radiation source pellet 8, and induces a cascade ionization that would not be possible in the absence of the at least one metallic particle 30. The excited plasma from the heavy noble gas atoms generates the EUV radiation 99.

Figure 4:
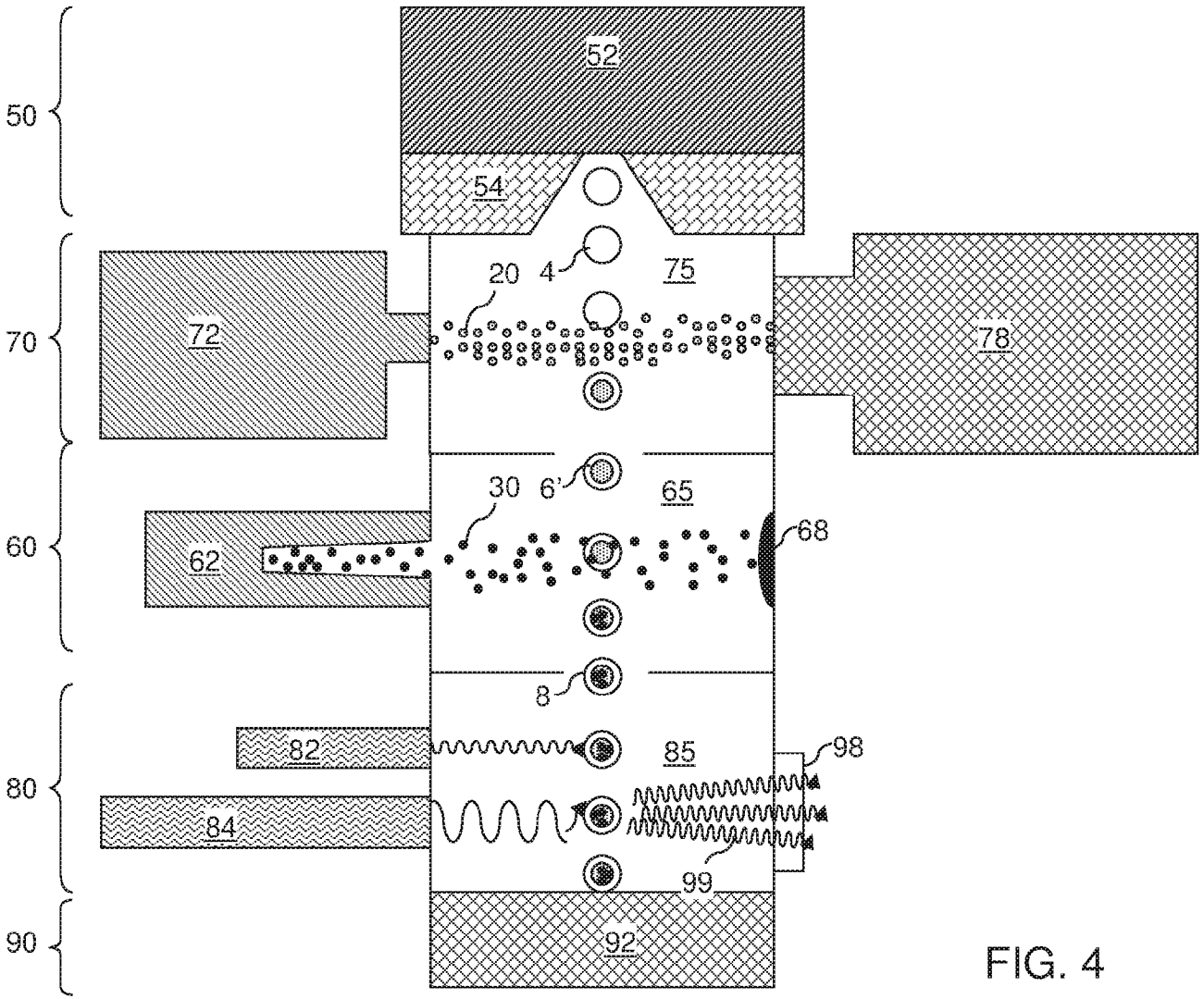
FIG. 4 is a schematic view of a second exemplary apparatus for generating EUV radiation according to a second embodiment of the present disclosure.

Referring to FIG. 4, a second exemplary apparatus for generating EUV radiation according to a second embodiment of the present disclosure includes an extreme ultraviolet (EUV) radiation source pellet generator (50, 70, 60) configured to generate EUV radiation pellets 8. Each EUV radiation source pellet 8 contains at least one metallic particle 30, a heavy noble gas cluster 20 embedding the at least one metallic particle 30, and a noble gas shell cluster 10 embedding the heavy noble gas cluster 20 and containing a cluster of a light noble gas selected from He, Ne, and Ar. The second exemplary apparatus further includes at least one irradiation source (82, 84). Each of the at least one laser irradiation source (82, 84) can be configured to irradiate a laser beam toward a path of the EUV radiation source pellets 8. The second exemplary apparatus can include a vacuum enclosure in which the EUV radiation source pellets 8 are generated and irradiated by at least one irradiation source.

The EUV radiation source pellet generator (50, 60, 70) includes a droplet generator unit 50 configured to emit clusters of a light noble gas selected from He, Ne, and Ar along a droplet transit path. The droplet generator unit 50 can be the same as in the first embodiment, and can generate the same clusters 4 of the light noble gas as in the first embodiment.

The EUV radiation source pellet generator (50, 60, 70) further includes a heavy noble gas cluster impregnation unit 70. The heavy noble gas cluster 20 is an aggregate with more than one heavy noble gas atom. The heavy noble gas cluster impregnation unit 70 includes a heavy noble gas cluster generator 72 configured to emit heavy noble gas clusters 20 along a heavy noble gas beam direction that intersects the droplet transit path at a region, which is herein referred to as a second intersect region. The heavy noble gas cluster impregnation unit 70 further includes a second vacuum chamber 75, which is a portion of the vacuum enclosure into which the clusters 4 of the light noble gas are emitted from the droplet generator unit 50. The heavy noble gas cluster generator 72 can be configured to generate heavy noble gas clusters 20 from a heavy noble gas source tank (not expressly shown) and to emit the heavy noble gas clusters 20 along a direction that intersects the path of the clusters 4 of the light noble gas. The heavy noble gas cluster impregnation unit 70 generates heavy noble gas cluster impregnated noble gas clusters 6' from combinations of clusters 4 of the light noble gas and the heavy noble gas clusters 20. At least one heavy noble gas cluster 20 is impregnated into the noble gas cluster 6 impregnated with at least one metallic particle 30. Multiple heavy noble gas clusters 20 impregnated into the noble gas cluster 6 impregnated with at least one metallic particle typically may coagulate at the center of the noble gas cluster 6 after impregnation. A vacuum pump 78 can be attached to the second vacuum chamber 75 on the opposite side of the heavy noble gas cluster generator 72 so that the heavy noble gas clusters 20 that are not incorporated into the heavy noble gas cluster impregnated noble gas clusters 6' are pumped away from the second vacuum chamber 75. The collection of the noble gas atoms in each EUV radiation source pellet 8 constitutes a noble gas cluster 10 that embeds a heavy noble gas cluster 20. Each noble gas cluster 10 can have a configuration of a shell that encases a heavy noble gas cluster 20 therein.

The EUV radiation source pellet generator (50, 60, 70) includes a metallic particle impregnation unit 60 that is adjoined to the droplet generator unit 50. The metallic particle impregnation unit 60 includes a metallic particle generator 62 configured to emit metallic particles 5 along a metallic particle beam direction that intersects the droplet transit path at a region, which is herein referred to as a first intersect region. The metallic particle impregnation unit 60 further includes a first vacuum chamber 65, which is adjoined to the second vacuum chamber 75 through an opening. The first vacuum chamber 65 is a portion of the vacuum enclosure into which the heavy noble gas cluster impregnated noble gas clusters 6' are emitted from the second vacuum chamber 75. The heavy noble gas cluster impregnated noble gas clusters 6' enter the first vacuum chamber 65 through an opening between the first vacuum chamber 65 and the second vacuum chamber 75. The metallic particle generator 62 can be any source that can generate a beam of metallic particles 30, which can have any of the metallic compositions described above. The beam of metallic particles 30 can cause formation of a metallic deposit portion 68 at a wall of the first vacuum chamber 65. The metallic particle impregnation unit 60 generates EUV radiation source pellets 8 from combinations of heavy noble gas cluster impregnated noble gas clusters 6' and the metallic particles 30.

The EUV radiation source pellets 8 of the second embodiment can be the same as the EUV radiation source pellets 8 of the first embodiment illustrated in FIG. 2 and the EUV radiation source pellets 8 illustrated in FIG. 1A, FIG. 1B, and FIG. 1C.

The first intersect region at which the metallic particles 30 are incorporated into a heavy noble gas cluster impregnated noble gas cluster 6' is located in the first vacuum chamber 65, and the second intersect region at which the heavy noble gas clusters 20 are incorporated into a cluster 4 of the light noble gas in the second vacuum chamber 75. As such, the second intersect region is more proximal to the location at which the clusters 4 of the light noble gas are emitted, i.e., the opening in the droplet generator unit 50, than the first intersect region is to the location at which the clusters 4 of the light noble gas are emitted.

The second exemplary apparatus can further include a radiation generation unit 80, which can be the same as in the first embodiment. The radiation generation unit 80 includes a third vacuum chamber 85, which is a portion of the vacuum enclosure and is connected to the second vacuum chamber 75 via an opening. The EUV radiation source pellets 8 can pass from the second vacuum chamber 75 into the third vacuum chamber 85 by a gravitational pull and the linear momentum of the pellets travelling substantially vertically downwards from chamber 75 to chamber 85. In this case, the path of the EUV radiation source pellets 8 within the third vacuum chamber 8 can be is substantially vertical downward path.

The radiation generation unit 80 further includes at least one irradiation source (82, 84), which can include a first irradiation source 82 configured to excite a plasma from the at least one metallic particle 30 within the EUV radiation source pellets 8 and a second irradiation source 84 configured to amplify the plasma of the at least one metallic particle and to generate a plasma of the heavy noble gas cluster 20. Each of the at least one irradiation source (82, 84) can be the same as in the first embodiment, and can function in the same manner as in the first embodiment.

While the disclosure has been described in terms of specific embodiments, it is evident in view of the foregoing description that numerous alternatives, modifications and variations will be apparent to those skilled in the art. Each of the embodiments described herein can be implemented individually or in combination with any other embodiment unless expressly stated otherwise or clearly incompatible. Accordingly, the disclosure is intended to encompass all such alternatives, modifications and variations which fall within the scope and spirit of the disclosure and the following claims.

What is claimed is:

1. A method for generating an extreme ultraviolet (EUV) radiation, said method comprising:

forming a plurality of extreme ultraviolet (EUV) radiation pellets within an EUV source pellet generator, said plurality of EUV radiation pellets comprising:

at least one metallic particle;

a heavy noble gas cluster embedding said at least one metallic particle; and a noble gas shell cluster embedding said heavy noble gas cluster and containing a cluster of a light noble gas selected from He, Ne, and Ar; and irradiating said plurality of EUV radiation pellets with at least one irradiation source, wherein each of said at least one irradiation source is configured to irradiate a laser beam toward a path of said EUV radiation pellets.

2. The method of claim 1, wherein said at least one irradiation source comprises:

a first laser source configured to irradiate a first laser beam at a first point in said path of said plurality of EUV radiation pellets; and a second laser source configured to irradiate a second laser beam at a second point in said path of said plurality of EUV radiation pellets, said second point being more distal from a location at which said plurality of EUV radiation pellets are generated than said first point is from said location.

3. The method of claim 2, wherein said second laser beam has an intensity that is greater than an intensity of said first laser beam by a factor of at least 2.

4. The method of claim 2, wherein said second laser beam has a longer wavelength than said first laser beam.

5. The method of claim 2, wherein said second laser beam is a laser beam from a $CO_2$ laser, and said first laser beam has a wavelength shorter than 800 nm.

6. The method of claim 1, wherein said EUV radiation source pellet generator comprises:

a droplet generator unit configured to emit clusters of said light noble gas He, Ne, and Ar along a droplet transit path;

a metallic particle generator configured to emit said at least one metallic particle along a metallic particle beam direction that intersects said droplet transit path at a first intersect region; and a heavy noble gas cluster beam generator configured to emit clusters of said heavy noble gas along a heavy noble gas cluster beam direction that intersects said drop transit path at a second intersect region.

7. The method of claim 6, wherein said first intersect region is more proximal to a location at which said clusters of said light noble gas are emitted than said second intersect region is to said location.

8. The method of claim 6, wherein said second intersect region is more proximal to a location at which said clusters of said light noble gas are emitted than said first intersect region is to said location.

9. The method of claim 6, wherein said at least one metallic particle is a plurality of metallic particles.

10. The method of claim 9, wherein said plurality of metallic particles are scattered within said heavy noble gas cluster.

11. The method of claim 9, wherein said plurality of metallic particles is in a configuration of a cluster in which said plurality of metallic particles is in physical contact with one another.

12. The method of claim 9, wherein said plurality of metallic particles is configured to be at an interface of said heavy noble gas cluster and said noble gas shell cluster.

13. The method of claim 9, wherein said at least one metallic particle comprises a single atom particle of a metallic element.

14. The method of claim 9, wherein said metallic element is tin.

15. The method of claim 1, wherein said path of said plurality of EUV radiation source pellets is a substantially vertical downward path.

16. The method of claim 1, wherein, in each of said plurality of EUV radiation source pellets, a total number of atoms of said light noble gas is greater than a total number of heavy noble gas atoms in said heavy noble gas cluster by a factor of at least two.

17. The method of claim 16, wherein, in each of said plurality of EUV radiation pellets, a total number of atoms of said light noble gas in said noble gas shell cluster is in a range from $10^4$ to $10^{16}$.

18. The method of claim 1, wherein, in each of said plurality of EUV radiation source pellets, a total number of heavy noble gas atoms in said heavy noble gas cluster is greater than a total number of said atoms in said at least one metallic particle by a factor of at least ten.

19. The method of claim 17, wherein, in each of said plurality of EUV radiation pellets, a total number of heavy noble gas atoms in said heavy noble gas cluster is in a range from $10^3$ to $10^{15}$.

* * * * *